US005494572A

United States Patent [19]

Horii et al.

[11] Patent Number: 5,494,572

[45] Date of Patent: Feb. 27, 1996

[54] DESULFURIZATION AND DENITRATION OF LIGHT OIL BY EXTRACTION

[75] Inventors: Yuji Horii; Hitoshi Onuki; Sadaaki Doi; Toshiatsu Mori; Takeo Takatori; Hideaki Sato; Tsuyoshi Ookuro; Toru Sugawara, all of Kawasaki, Japan

[73] Assignee: General Sekiyu Kabushikikaisha, Tokyo, Japan

[21] Appl. No.: 458,554

[22] Filed: Jun. 2, 1995

Related U.S. Application Data

[60] Continuation of Ser. No. 223,031, Apr. 5, 1994, abandoned, which is a division of Ser. No. 959,440, Oct. 13, 1992, abandoned.

[30] Foreign Application Priority Data

Oct. 15, 1991 [JP] Japan ..... 3-295105
Oct. 9, 1992 [JP] Japan ..... 4-298076

[51] Int. Cl.[6] ..... C10G 29/00

[52] U.S. Cl. ..... 208/263; 208/12; 208/254 H; 208/237

[58] Field of Search ..... 208/236, 254, 208/12

[56] References Cited

U.S. PATENT DOCUMENTS

| | | | |
|---|---|---|---|
| 2,846,358 | 8/1958 | Breber et al. | 208/212 |
| 3,052,625 | 9/1962 | Gordon et al. | 208/212 |
| 3,175,970 | 3/1965 | Bercik et al. | 208/212 |
| 4,085,036 | 4/1978 | Murphy, Jr. | 208/212 |
| 4,539,404 | 9/1985 | Thompson et al. | 544/335 |
| 4,746,420 | 5/1988 | Darian et al. | 208/222 |
| 4,770,763 | 9/1988 | Kusayanagi et al. | 208/18 |
| 4,909,925 | 3/1990 | Hodgson | 208/208 |
| 5,137,831 | 8/1992 | Gruteser | 436/52 |

*Primary Examiner*—Helane Myers
*Attorney, Agent, or Firm*—Oliff & Berridge

[57] ABSTRACT

This process for the desulfurization and denitration of light oil is effected by extraction with an organic solvent containing nitrogen. The invention also relates to light oil desulfurized and denitrated by said process as well as an organic solvent containing nitrogen for the extraction. The solvent is selected from among, for example, hetrocyclic compounds containing nitrogen, such as pyrrolidones, imidazolidinones, pyrimidinones and pyridinium salts, and acid amides. The combination of the process of this invention with any ordinary process for hydrodesulfurization enables the production of light oil having a sulfur content not exceeding 0.01% by weight. Light oil still containing benzothiophenone and dibenzothiophenone derivatives after hydrodesulfurization can be easily desulfurized to yield a desulfurized product not having any undesirable color, or any offensive smell. Also, the extraction of nitrogen compounds and aromatic compound from light oil is effected by the same process. As the re-extraction of sulfur compounds from the extracted phase or the separation of the extracted phase into the solvent and the extracted oil can be easily carried out, the solvent is reusable. The light oil treated according to the process of this invention enables a reduction of particulates in the combustion product thereof, and has a high cetane index.

7 Claims, 3 Drawing Sheets

DESULFURIZATION AND DENITRATION OF LIGHT OIL BY EXTRACTION

This is a continuation of application Ser. No. 08/223,031 filed Apr. 5, 1994, now abandoned, which in turn is a division of application Ser. No. 07/959,440, filed Oct. 13, 1992, now abandoned.

BACKGROUND OF THE INVENTION

1. Field of the Invention

This invention relates to the desulfurization and denitration of light oil by extraction.

2. Description of Prior Art

The term "light oil" means either an intermediate or a final product obtained from the process of petroleum refining. Light oil as an intermediate product usually contains about 1% by weight of sulfur compounds. The sulfur compounds not only exert an adverse effect on the quality of petroleum products, but also form as a result of combustion sulfur oxides which cause environmental pollution. Light oil is, therefore, desulfurized to make a wide range of products including a cleanser, a fuel for a diesel engine, or burner, absorption oil, oil gas, and thermally or catalytically cracked gasoline.

The removal of sulfur compounds from light oil has hither-to been effected almost exclusively by hydrodesulfurization. The hydrodesulfurization of light oil is effected at high temperature in the range of about 280° to 340° C. and a high pressure in the range of about 20 to 50 bars in the presence of a catalyst, e.g. a cobalt-molybdenum catalyst on a support of alumina, to remove sulfur compounds by converting them to hydrogen sulfide and hydrocarbons.

The conventional process of hydrodesulfurization as hereinabove described enables a reduction in the sulfur content of light oil to a level of 0.07 to 0.08% by weight, and can, therefore, satisfy the presently existing regulation which specifies an upper limit of 0.5% by weight for the sulfur content of light oil. It is, however, expected that a new upper limit of 0.05% by weight will be set in the near future for the purpose of e.g. environmental protection, and if such is the case, the conventional process will become useless. From a technical standpoint, it is possible to obtain a hydro-desulfurized product of light oil having a sulfur content not exceeding 0.05% by weight, but for that purpose, it is necessary to employ by far higher temperature and pressure than have hitherto been employed, and therefore to use new equipment and larger amounts of energy and hydrogen. Moreover, the hydrodesulfurized product has a black color which has to be removed before it can be a commercially desirable product. This color becomes more remarkable with a reduction in the sulfur content of the product. It also has an offensive smell. These problems make it undesirable as a commercially acceptable product.

In addition, light oil contains nitrogen compounds in concentration of from about a hundred to several hundreds ppm. As the nitrogen compounds form as a result of combustion $NO_M$ which causes environmental pollution, it is desirable to remove said nitrogen compounds from light oil as much as possible. But the efficient denitration of light oil has not been reported.

SUMMARY OF THE INVENTION

Under these circumstances, it is an object of this invention to provide a process which can easily be carried out for the desulfurization of light oil without calling for the installation of any new hydrodesulfurization apparatus and yield a desulfurized product of light oil not having any particular color, or any offensive smell. It is another object of this invention to provide a process for denitration of light oil by extraction. It is further object of this invention to provide desulfurized and denitrated light oil as well as a solvent for the desulfurization and denitration of light oil.

We, the inventors of this invention, have found that, while light oil contains aliphatic and aromatic sulfur compounds, it is mainly aromatic sulfur compounds that remain unremoved in a hydrodesulfurized product of light oil. We have, therefore, made an extensive scope of research work to explore a method of removing aromatic sulfur compounds from light oil, and found that extraction, which has hitherto not been employed for desulfurizing light oil, can desulfurize light oil easily and effectively, particularly if it is perfomed by using a specific kind of organic solvent and found that extraction with said specific solvent is effective for the denitration of light oil.

Thus, the above object is essentially attained by a process for the desulfurization of light oil which comprises subjecting light oil to extraction with an organic solvent containing nitrogen.

This invention also relates to a process for the denitration of light oil which comprises subjecting light oil to extraction with an organic solvent containing nitrogen.

Further, this invention relates to light oil desulfurized by extraction with an organic solvent containing nitrogen, and to light oil denitrated by extraction with an organic solvent containing nitrogen.

Also, this invention relates to a solvent for the desulfurization of light oil by extraction, which comprises an organic compound containing nitrogen, and to a solvent for the denitration of light oil by extraction, which comprises an organic compound containing nitrogen.

In addition, this invention relates to a process for the decolorization of light oil which comprises subjecting light oil to extraction with an organic solvent containing nitrogen.

The process of this invention can easily remove from light oil sulfur compounds, mainly such as benzothiophene and dibenzothiophene derivatives, which cannot be removed effectively by hydrodesulfurization. The combination of the process of this invention with an ordinary process of hydrodesulfurization yields a desulfurized product of light oil having a very low sulfur content not exceeding 0.01% by weight.

The light oil desulfurized by the process of this invention does not have any offensive smell, since it removes the thiophenes which have been the source of the offensive smell. Moreover, it has no particular color. The process of the invention can also be used to decolor a hydrodesulfurized product of light oil. A particularly good result of decoloration can be obtained if a solvent selected from among pyrrolidones, imidazolidinones and acid amides is used for extraction.

The process of this invention also enables the reuse of an extraction solvent, as it is easy to extract sulfur compounds back from the solvent used for treating light oil. In addition, it is able to regenerate an extraction solvent at lower cost by adding water to the solvent used for treating light oil.

The aromatic compounds which light oil contains are also responsible for an increase of particulates in the combustion product thereof. The process of this invention can, however, produce light oil having a sufficiently low content of aromatic compounds to achieve a decrease of such particulates, and therefore, light oil of outstanding quality having a high cetane number. In particular, the process of this invention can preferentially remove from light oil polycyclic aromatic compounds which are a principal factor of particulates.

The process for the denitration of this invention can remove from light oil nitrogen compounds only by extraction which is a simple process. Therefore said process of this invention can be a drastic measure for reducing $NO_M$ originated from light oil.

Moreover the desulfurization and denitration of this invention is found to be effected in the order of selectivity shown below:

Nitrogen compounds>sulfur compounds>aromatic compounds.

Therefore more selective desulfurization and denitration can be achieved by the process of this invention.

When the process of this invention is done by the multistage extraction, it can reduce the solvent ratio which is the proportion by weight of the solvent to that of the light oil taken as 1, and raise the rate of desulfurization, the rate of denitration and the yield of raffinate oil.

Other features and advantages of this invention will be apparent from the following description and the accompanying drawings.

DETAILED DESCRIPTION OF THE INVENTION

Figure 1:
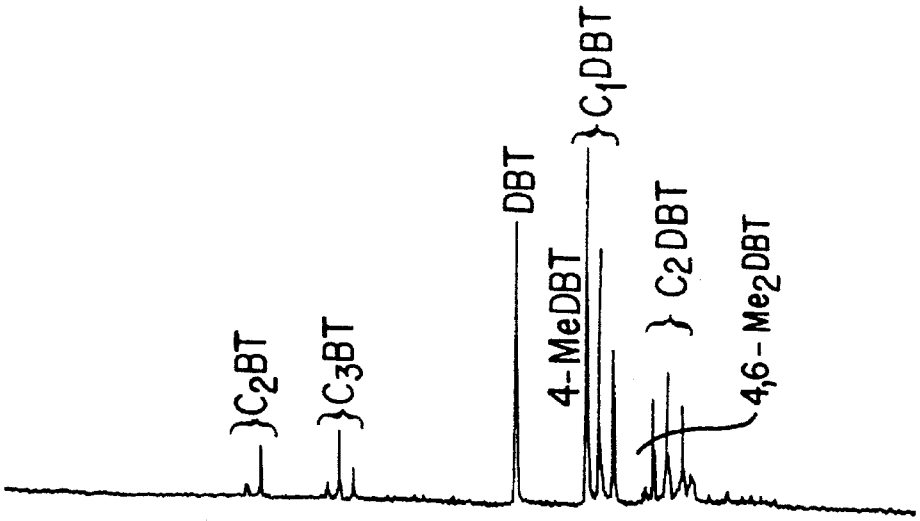
FIG. 1 is a standard chromatogram obtained from standard samples of benzothiophene derivatives.

For the purpose of this invention, light oil is a petroleum fraction having a boiling range between those of kerosine and heavy oil, and containing sulfur compounds such as thiols, sulfides and thiophenes and/or nitrogen compounds such as carbazoles that have to be removed. It may, or may not be a product of hydrodesulfurization. If the latter is the case, hydrodesulfurization may be necessary after extraction according to the process of this invention to ensure that a still better result of desulfurization be obtained.

The process of this invention is carried out by employing an organic solvent containing nitrogen. The solvent is employed for removing mainly aromatic thiophenes and carbazoles from light oil. A heterocyclic compound containing nitrogen, or an acid-amide compound is preferably used as the solvent. It is possible to use either a single compound or a mixture of compounds, or even a mixture of a compound containing nitrogen and a compound not containing nitrogen.

Examples of the heterocyclic compounds containing nitrogen which can be employed are heterocyclic ketones containing nitrogen, such as pyrrolidones, imidazolidinones, pyrimidinones, piperidones, pyrazolidinones and piperazinones. It is possible to use either an unsubstituted or an alkyl-substituted compound. Pyrrolidones such as N-methyl-2-pyrrolidone and N-ethyl-2-pyrrolidone, imidazolidinones such as 1,3-dimethyl-2-imidazolidinone, 1,3-diethyl-2-imidazolidinone, and pyrimidinones such as 1,3-dimethyl-3,4,5,6-tetrahydro-2-pyrimidinone, are, among others, preferred. Other examples are pyridinium salts, such as trimethylpyridinium hydrobromide, 1,2,4,6-tetramethylpyridinium iodide and N-ethylpyridinium bromide. If a pyridinium salt is used as the solvent, the use of another solvent having one or more hydroxyl groups, such as methanol, ethanol, ethylene glycol or glycerol with the pyridinium salt is preferred from the standpoint of extraction efficiency.

Example of the acid-amide compounds include dimethylformamide, diethylformamide, and dimethylacetamide.

Apart from using a specific kind of solvent, the process of this invention is carried out by following any ordinary process for liquid-liquid extraction. Thus, the light oil to be desulfurized and the solvent are mixed in appropriate proportions, and after a vessel containing their mixture has been shaken for an appropriately long time at room temperature, it is separated into two phases and the solvent phase is removed from the vessel. The oil phase is, then, rinsed with e.g. water, if required. Although the extraction process is usually carried out at room temperature, it is possible to heat the liquid mixture to obtain a higher extraction efficiency.

The mixing proportion of light oil and a solvent depends on the sulfur content and nitrogen content of the light oil to be treated and the nature of the solvent, and preferably the weight proportion of light oil and a solvent is 1:0.5–4.0. It is preferable that a solvent is used as little as possible from the standpoint of the process cost. When the multistage extraction is effected according to this invention, good results of desulfurization and denitration are obtained even though the solvent ratio is low.

When water is added to the solvent in this invention, the yield of raffinate oil can be increased.

The sulfur content of desulfurized light oil and the nitrogen content of denitrated light oil vary in wide range depending upon the sulfur content and nitrogen content of untreated light oil and the nature of the solvent used. Although it is preferable that both contents of treated light oil are as little as possible, the combination of the process of this invention with an ordinary process of hydrodesulfurization yields a desulfurized and denitrated product of light oil having sulfur content and nitrogen content not exceeding 0.1% by weight and 100 ppm, in particular not exceeding 0.01% by weight and 20 ppm, respectively.

The invention will now be described in further detail with reference to specific examples. It is, however, to be understood that the following description is not intented for limiting the scope of this invention.

A. Desulfurization by Extraction

In EXAMPLES 1 to 10 and COMPARATIVE EXAMPLES 1 to 5, two samples of light oil having sulfur contents of 0.191% and 0.045% by weight, respectively, were employed, and will be referred to as light oils A and B, respectively. They were both hydrodesulfurized products containing 26 to 27% by volume of aromatic compounds.

A-1: Test of Desulfurization

EXAMPLE 1

A separatory funnel was charged with N-methyl-2-pyrrolidone (NMP) as an extraction solvent and light oil A in the weight proportion of 2.55:1, and after it had been satisfactorily shaken, it was left to stand to allow the separation of two phases. The oil phase was collected, and rinsed with water three times to yield a desulfurized product. It did not have any particular color, or any offensive smell peculiar to thiophenes. The sulfur content of the product was determined by the radiation type excite method according to JIS K 2541.

EXAMPLE 2

EXAMPLE 1 was repeated, except that 1,3-dimethyl-2-imidazolidinone (DMI) was employed as the solvent, and that the solvent and light oil A had the weight proportion of 3.06:1. The desulfurized oil did not have any particular color, or any offensive smell.

EXAMPLE 3

EXAMPLE 1 was repeated, except that dimethylformamide (DMF) was employed as the solvent, and that the solvent and light oil A had the weight proportion of 2.59:1. The desulfurized oil did not have any particular color, or any offensive smell.

COMPARATIVE EXAMPLES 1 TO 3

EXAMPLE 1 was repeated, except that sulfuran (SULF), dimethyl sulfoxide (DMSO) or ethylene glycol (EG) was employed as the solvent, and that these conventional solvents were used in a weight proportion as shown in TABLE 1 below. All of the desulfurized products were undesirably colored, and had an offensive smell peculiar to thiophenes.

TABLE 1 shows the sulfur content of each of the desulfurized products of EXAMPLES 1 to 3 and COMPARATIVE EXAMPLES 1 to 3. In the table, the "solvent ratio" is the proportion by weight of the solvent to that of the light oil taken as 1, and the "rate of desulfurization" is the ratio by percentage of the sulfur content of the solvent after extraction to that of the untreated light oil taken as 100.

TABLE 1

Desulfurization of light oil A (having a sulfur content of 0.191% by weight)

| | EXAMPLE | | | COMPARATIVE EXAMPLE | | |
|---|---|---|---|---|---|---|
| | 1 | 2 | 3 | 1 | 2 | 3 |
| Solvent | NMP | DMI | DMF | SULF | DMSO | EG |
| Solvent ratio | 2.55 | 3.06 | 2.59 | 2.94 | 2.47 | 2.25 |
| Sulfur content of desulfurized oil (wt. %) | 0.072 | 0.064 | 0.091 | 0.137 | 0.126 | 0.181 |
| Rate of desulforization (%) | 74.9 | 77.1 | 58.6 | 35.8 | 37.5 | 7.9 |

As is obvious from TABLE 1, the process of this invention enabled by far higher rates of desulfurization than were obtained when the conventional extraction solvents had been employed.

EXAMPLE 4

A separatory funnel was charged with NMP, the solvent, and light oil B in the weight proportion of 2.51:1, and after it had been satisfactorily shaken, it was left to stand to allow the separation of two phases. The oil phase was collected, and rinsed with water three times to yield a desulfurized product. It did not have any particular color, or any offensive smell peculiar to thiophenes. The sulfur content of the product was determined by the radiation type excite method according to JIS K 2541.

EXAMPLE 5

EXAMPLE 4 was repeated, except that DMI was employed as the solvent in the weight proportion of 3.07:1 to light oil B. The desulfurized oil did not have any particular color, or any offensive smell.

EXAMPLE 6

EXAMPLE 4 was repeated, except that DMF was employed as the solvent in the weight proportion of 2.51:1 to light oil B. The desulfurized oil did not have any particular color, or any offensive smell.

TABLE 2 shows the sulfur content of each of the desulfurized products of EXAMPLES 4 to 6. In the table, the "solvent ratio" and the "rate of desulfurization" are as defined with reference to TABLE 1, and the "recovery" means the ratio by the percentage of the weight of the oil recovered after desulfurization to the original weight of the oil taken as 100.

TABLE 2

Desulfurization of light oil B (having a sulfur content of 0.045% by weight)

| | EXAMPLE | | |
|---|---|---|---|
| | 4 | 5 | 6 |
| Solvent | NMP | DMI | DMF |
| Solvent ratio | 2.51 | 3.07 | 2.51 |
| Sulfur content of desulfurized oil (wt. %) | 0.009 | 0.008 | 0.016 |
| Rate of desulfurization (%) | 87.2 | 88.4 | 79.9 |
| Recovery (%) | 64.2 | 65.2 | 81.9 |

As is obvious from TABLE 2, the solvent employed for the process of this invention showed very high rates of desulfurization for light oil having a low sulfur content, too.

EXAMPLE 7

A separatory funnel was charged with an extraction solvent, which a solution of 20.06 g of trimethylpyridinium hydrobromide (TMPB) in 100 g of methanol, and light oil A in the weight proportion of 2.49:1, and after it had been satisfactorily shaken, it was left to stand to allow the separation of two phases. The oil phase was recovered, and rinsed with water three times to yield a desulfurized product. It had no offensive smell. The sulfur content of the product was determined by the radiation type excite method according to JIS K 2541.

COMPARATIVE EXAMPLE 4

EXAMPLE 7 was repeated, except that methanol (MEOW) was employed as the extraction solvent in the weight proportion of 2.62:1 to light oil A. The desulfurized product was undesirably colored, and had an offensive smell peculiar to thiophenes.

TABLE 3 shows the sulfur content of each of the products of EXAMPLE 7 and COMPARATIVE EXAMPLE 4. In the table, the "solvent ratio" and the "rate of desulfurization" are as defined above with reference to TABLE 1.

TABLE 3

Desulfurization of light oil A (having a sulfur content of 0.191% by weight)

| | EXAMPLE 7 | COMPARATIVE EXAMPLE 4 |
|---|---|---|
| Solvent | TMPB | MEOH |
| Solvent ratio | 2.49 | 2.62 |
| Sulfur content of desulfurized oil (wt. %) | 0.122 | 0.146 |
| Rate of desulfurization (%) | 44.3 | 37.2 |

As is obvious from TABLE 3, the pyridinum salt employed for the process of this invention enabled higher rates of desulfurization than the extraction solvent consisting merely of menthanol did.

EXAMPLE 8

A separatory funnel was charged with an extraction solvent, which a solution containing 19.89 g of TMPB in 100 g of methanol, and light oil B in the weight proportion of 3.02:1, and after it had been satisfactorily shaken, it was left to stand to allow the separation of two phases. The oil phase was collected, and rinsed with water three times to yield a desulfurized product. It had no offensive smell. The sulfur content of the product was determined by the radiation type excite method according to JIS K 2541.

EXAMPLE 9

EXAMPLE 8 was repeated, except that a solution containing 71.66 g of 1,2,4,6-tetramethylpyridinium iodide (TMPI) in 100 g of methanol was used as the extraction solvent in the weight proportion of 3.00:1 to light oil B. The desulfurized oil had no offensive smell.

EXAMPLE 10

EXAMPLE 8 was repeated, except that a solution containing 49.99 g of N-ethylpyridinium bromide (NEPB) in 100 g of methanol was used as the extraction solvent in the weight ratio of 2.58:1 to light oil B. The desulfurized oil had no offensive smell.

COMPARATIVE EXAMPLE 5

EXAMPLE 8 was repeated, except that methanol was employed as the extraction solvent in the weight proportion of 2.44:1 to light oil B. The desulfurized product was undesirably colored, and had an offensive smell peculiar to thiophenes.

TABLE 4 shows the sulfur content of each of the desulfurized products of EXAMPLES 8 to 10 and COMPARATIVE EXAMPLE 5. In the table, the "solvent ratio" the "rate of desulfurization" and the "recovery" are as defined above with reference to TABLES 1 and 2.

TABLE 4

Desulfurization of light oil B (having a sulfur content of 0.045% by weight)

| | EXAMPLE | | | COMPARATIVE EXAMPLE |
|---|---|---|---|---|
| | 8 | 9 | 10 | 5 |
| Solvent | TMPB | TMPI | NEPB | MEOH |
| Solvent ratio | 3.02 | 3.00 | 2.58 | 2.44 |
| Sulfur content of desulfurized oil (wt. %) | 0.025 | 0.021 | 0.028 | 0.033 |
| Rate of desulfurization (%) | 55.5 | 58.7 | 49.5 | 40.0 |
| Recovery (%) | 80.2 | 88.4 | 87.5 | 81.8 |

As is obvious from TABLE 4, the pyridinum salts employed for the process of this invention enabled higher rates of desulfurization than were achieved when methanol alone had been used as the extraction solvent, as well as very high percentages of oil recovery.

A-2: Back Extraction

The solvent phases which had been separated after extraction in EXAMPLES 1 to 10 were subjected to back extraction with hexane. As a result, almost all of the sulfur compounds which each solvent had removed from light oil could be transfered into the hexane. The solvent could, therefore, be reused for desulfurization purposes.

A-3: Analysis by Gas Chromatography

Analysis was made by gas chromatography of the sulfur components of each of the untreated light oils and various oil and solvent phases separated after extraction. Detection was made by a flame color intensity detector capable of detecting the sulfur components. The chromatograms which were obtained are shown in FIGS. 1 to 9. FIG. 1 is a standard chromatogram prepared from standard samples for indicating the holding time of each of various benzothiophene derivatives, and FIGS. 2 to 9 are the chromatograms representing untreated light oil A, the oil phase obtained in EXAMPLE 2, the solvent phase obtained in EXAMPLE 2, untreated light oil B, the oil phase obtained in EXAMPLE 4, the oil phase obtained in EXAMPLE 5, the oil phase obtained in EXAMPLE 6 and the oil phase obtained in EXAMPLE 9, respectively. The symbols used to show the peaks in the chromatograms mean the following compounds, respectively:

| | |
|---|---|
| $C_2BT$ | dimethylbenzothiophene, |
| $C_3BT$ | trimethylbenzothiophene, |
| DBT | dibenzothiophene, |
| $C_1DBT$ | methyldibenzothiophene, |
| 4-MeDBT | 4-methyldibenzothiophene, |
| $C_2DBT$ | dimethyldibenzothiophene, and |
| 4,6-$Me_2DBT$ | 4,6-dimethyldibenzothiophene. |

Figure 2:
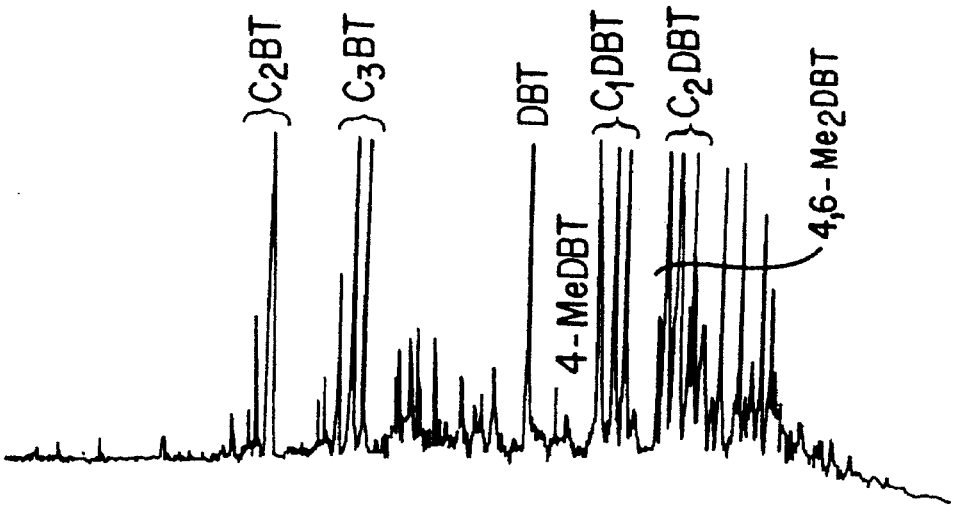
FIG. 2 is a chromatogram of untreated light oil A.
Figure 3:
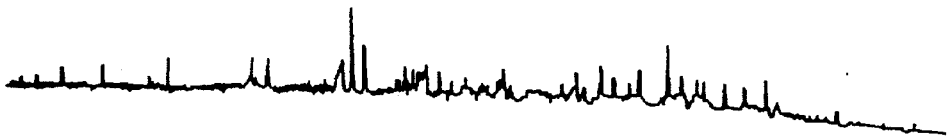
FIG. 3 is a chromatogram of the oil phase obtained in EXAMPLE 2.
Figure 4:
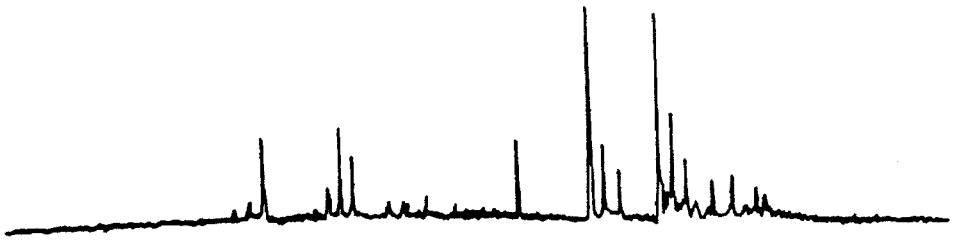
FIG. 4 is a chromatogram of the solvent phase obtained in EXAMPLE 2.
Figure 5:
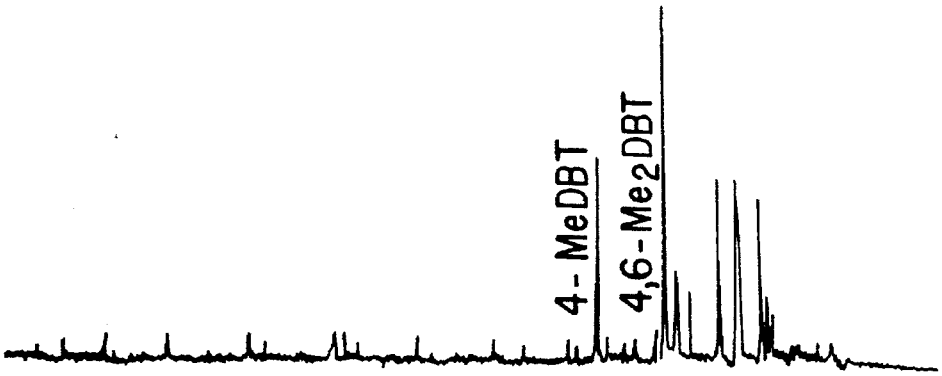
FIG. 5 is a chromatogram of untreated light oil B.
Figure 6:
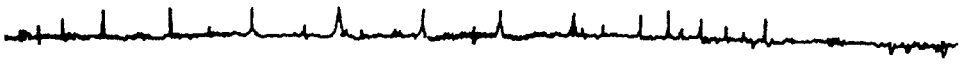
FIG. 6 is a chromatogram of the oil phase obtained in EXAMPLE 4.
Figure 7:
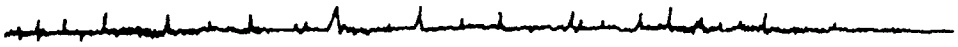
FIG. 7 is a chromatogram of the oil phase obtained in EXAMPLE 5.
Figure 8:
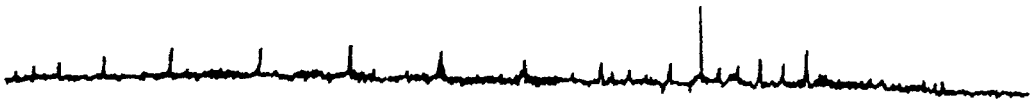
FIG. 8 is a chromatogram of the oil phase obtained in EXAMPLE 6.
Figure 9:
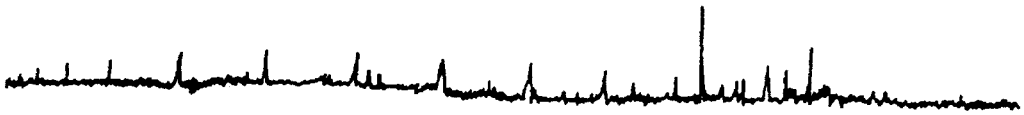
FIG. 9 is a chromatogram of the oil phase obtained in EXAMPLE 9.

As is obvious from FIGS. 2 to 4, the extraction of light oil A containing various thiophenes (FIG. 2) with the nitrogen-containing organic solvent forming a salient feature of this invention enabled the removal of almost all of the sulfur components from the oil (FIG. 3) and the transfer thereof into the solvent phase (FIG. 4). As is obvious from FIGS. 5 to 8, the extraction of light oil B containing various thiophenes (FIG. 5) enabled the substantially complete removal of the sulfur components from the oil (FIGS. 6 to 8). As is obvious from FIGS. 5 and 9, the use of still another compound as extraction solvent also enabled the substantially complete removal of the sulfur components from the light oil B. The small peaks which appear at substantially regular interval in the chromatograms shown in FIGS. 5 to 9 correspond to normal hydrocarbons.

The results of analysis by gas chromatography as described confirm the effective transfer of the benzothiophenes into the solvent phase and thereby the usefullness of the process of this invention in the removal of the sulfur components from light oil.

B. Desulfurization and Denitration by Extraction

Next, the examination of desulfurization and denitration of light oil different from light oils A and B by extraction were carried out.

B-1: The Relation between Rate of Desulfurization/Denitration and Solvent Ratio

In the example, a sample of light oil having sulfur content of 0.198% by weight and nitrogen content of 202 ppm, which is called IGO and is an intermediate product, were employed, and will be referred to as light oil C. A separatory funnel was charged with light oil C and N-methyl-2-pyrrolidone (NMP) as an extraction solvent in a weight proportion of 1:0.5–4.0, and after it had been satisfactorily shaken, it was left to stand to allow the separation of two phases, a raffinate phase and an extracted phase. From both phases each oil phase was collected. The sulfur content and nitrogen content of said each oil phase were determined by the radiation type excite method according to JIS K 2541 and the nitrogen analysis method by chemiluminescence according to JIS K 2609, respectively. Also, these oil phases were subjected to FIA analysis according to JIS K 2536. In addition, the oil phase from the raffinate phase was subjected to the determination of Saybolt color according to JIS K 2580 and the analysis of aromatic components by means of liquid chromatography on silica gel. The results are summarized in TABLE 5.

TABLE 5

| | Untreated light oil | Light oil C treated with solvent below | | | | |
|---|---|---|---|---|---|---|
| | | NMP | NMP | NMP | NMP | NMP |
| Solvent ratio | — | 0.5 | 1.0 | 1.5 | 2.5 | 4.0 |
| Yield (wt %) | | | | | | |
| RAFF | 89.2 | 82.4 | 76.8 | 69.5 | 61.0 | |
| EXT | — | 10.8 | 17.6 | 23.2 | 30.5 | 39.0 |
| Sulfur content (wt. %) | | | | | | |
| RAFF | 0.198 | 0.124 | 0.092 | 0.073 | 0.057 | 0.042 |
| EXT | — | 0.858 | 0.731 | 0.626 | 0.537 | 0.448 |
| Nitrogen content (ppm) | | | | | | |
| RAFF | 202 | 76 | 51 | 38 | 27 | 19 |
| EXT | — | 1100 | 860 | 680 | 510 | 360 |
| Saybolt color | <−16 | — | +6 | — | +16 | — |
| FIA (vol %) | | | | | | |
| RAFF | | | | | | |
| SAT | 79.3 | 83.6 | 87.1 | 88.8 | 93.1 | 94.3 |
| AROM | 20.7 | 16.4 | 12.9 | 11.2 | 6.9 | 5.7 |
| EXT | | | | | | |
| SAT | — | 36.5 | 40.8 | 46.5 | 51.1 | 52.4 |
| AROM | — | 63.5 | 59.2 | 53.5 | 48.9 | 47.6 |
| Aromatic component of RAFF (vol %) | | | | | | |
| monocyclic | 9.1 | 8.5 | 8.1 | 7.2 | 6.1 | 5.6 |
| polycyclic | 13.1 | 7.0 | 5.1 | 3.8 | 2.7 | 0.0 |
| Selection rate | | | | | | |
| S vs AROM | — | 1.94 | 1.88 | 1.93 | 1.43 | 1.38 |
| N vs AROM | — | 4.06 | 3.99 | 4.04 | 2.87 | 2.32 |
| S vs OIL | — | 6.92 | 7.95 | 8.58 | 9.42 | 10.67 |
| N vs OIL | — | 14.47 | 16.86 | 17.89 | 18.89 | 18.00 |
| Rate of desulfurization (%) | — | 44.5 | 62.1 | 71.6 | 80.1 | 87.3 |
| Rate of denitration (%) | — | 66.7 | 79.4 | 85.5 | 90.8 | 94.1 |

(Footnote)
Solvent ratio: the proportion by weight of the solvent to that of the light oil taken as 1,
RAFF: raffinate oil,
EXT: extracted oil.

TABLE 5-continued

| | Untreated light oil | Light oil C treated with solvent below | | | | |
|---|---|---|---|---|---|---|
| | | NMP | NMP | NMP | NMP | NMP |

FIA: the results of FIA analysis, "SAT" means saturated hydrocarbon content, and "AROM" means aromatic hydrocarbon content.
Selection rate: each rate is calculated according to following formulae:
S vs AROM = [(sulfur content of EXT phase)/(sulfur content of RAFF phase)]/[(AROM of EXT phase)/(AROM of RAFF phase)]
N vs AROM = [(nitrogen content of EXT phase)/(nitrogen content of RAFF phase)]/[(AROM of EXT phase)/(AROM of RAFF phase)]
S vs OIL = [(sulfur content of EXT phase)/(sulfur content of RAFF phase)]/[(extracted oil content of EXT phase)/(raffinate oil content of RAFF phase)]
N vs OIL = [(nitrogen content of EXT phase)/(nitrogen content of RAFF phase)]/[(extracted oil content of EXT phase)/(raffinate oil content of RAFF phase)]

As is obvious from TABLE 5, the rate of desulfurization and the rate of denitration increased with the rise of the solvent ratio, though the yield of raffinate was decreased. In particular, when the solvent ratio is 2.5 and more, the rate of desulfurization and the rate of denitration exceeded 80% and 90%, respectively. In addition, it was recognized that the solvent in this invention had the significant effect of decolorization. Further, it was proved that the solvent in this invention tended to extract polycyclic aromatic components more than monocyclic ones. Meanwhile, as polycyclic aromatic components are a principal factor of particulates emitted from diesel engines, the solvent in this invention enables light oil to increase in cetane index.

The properties of untreated light oil and each raffinate oil obtained by extraction described above are summarized in TABLE 6.

TABLE 6

| | Untreated light oil | Light oil C treated with solvent below | | | | |
|---|---|---|---|---|---|---|
| | | NMP | NMP | NMP | NMP | NMP |
| Solvent ratio | — | 0.5 | 1.0 | 1.5 | 2.5 | 4.0 |
| Density (15° C.) | 0.8465 | 0.8376 | 0.8330 | 0.8302 | 0.8268 | 0.8235 |
| Sulfur content (wt. %) | 0.198 | 0.124 | 0.092 | 0.073 | 0.057 | 0.042 |
| Nitrogen content (ppm) | 202 | 76 | 51 | 38 | 27 | 19 |
| FIA (Vol %) | | | | | | |
| SAT | 79.3 | 83.6 | 87.1 | 88.8 | 93.1 | 94.3 |
| AROM | 20.7 | 16.4 | 12.9 | 11.2 | 6.9 | 5.7 |
| OLE | 0 | 0 | 0 | 0 | 0 | 0 |
| Kinetic viscosity (30° C.) Cst | 6.058 | 6.072 | 6.120 | 6.131 | 6.211 | 6.291 |
| Cetane index | | | | | | |
| JIS | 59.6 | 63.4 | 65.7 | 67.2 | 69.0 | 70.6 |
| ASTM | 60.4 | 65.0 | 67.7 | 69.4 | 71.9 | 74.0 |
| Pour point °C. | 0 | 0 | 0 | +2.5 | +2.5 | +5 |
| Cloud point °C. | +2 | +3 | +3 | +4 | +4 | +6 |
| CFPP °C. | −2 | −3 | 0 | 0 | +1 | +1 |
| Flash point °C. | 104 | 107 | 105 | 109 | 108 | 110 |
| Shade (ASTM) | L1.5 | 0.5 | L0.5 | L0.5 | L0.5 | L0.5 |

(Footnote)
In the column of cetane index, "JIS" means the values obtained according to JIS K 2536, and in the column of cetane index and shade, "ASTM" means the values obtained according to ASTM.

B-2: Desulfurization/Denitration with Various Solvents

A separatory funnel was charged with light oil C used in B-1 and 1,3-dimethyl-2-imidazolidinone (DMI), dimethylacetoamide (DMA), dimethylformamide (DMF), ethylsuccinylamide (ESI) or 1,3-dimethyl-3,4,5,6-tetrahydro-2-pyrimidinone (DTP) which is an extraction solvent in this invention, in the weight proportion of 1:1, and after it had been satisfactorily shaken, it was left to stand to allow the separation of two phases, a raffinate phase and an extracted phase. From both phases each oil phase was collected. The sulfur content and nitrogen content of said each oil phase were determined by the radiation type excite method according to JIS K 2541 and the nitrogen analysis method by chemiluminescence according to JIS K 2609, respectively. Also, these oil phases were subjected to FIA analysis according to JIS K 2536. Further, Saybolt color of the oil phase from the raffinate phase was determined according to JIS K 2580. The results are summarized in TABLE 7. In addition, the extraction with diethylene glycol (DEG), furfral (FURF), sulfuran (SULF) or dimethyl sulfoxide (DMSO) was effected in a similar manner as above. The results are summarized in TABLE 8.

TABLE 7

| | Light oil C treated with solvent below | | | | | |
|---|---|---|---|---|---|---|
| | NMP | DMI | DMA | DMF | ESI | DTP |
| Solvent ratio | 1.0 | 1.0 | 1.0 | 1.0 | 1.0 | 1.0 |
| Yield (wt %) | | | | | | |
| RAFF | 82.4 | 85.2 | 81.7 | 88.1 | 92.1 | 79.3 |
| EXT | 17.6 | 14.8 | 18.3 | 11.9 | 7.9 | 20.7 |
| Sulfur content (wt. %) | | | | | | |
| RAFF | 0.092 | 0.095 | 0.102 | 0.110 | 0.131 | 0.097 |
| EXT | 0.731 | 0.812 | 0.674 | 0.895 | 1.031 | 0.627 |
| Nitrogen content (ppm) | | | | | | |
| RAFF | 51 | 58 | 58 | 63 | 72 | 60 |
| EXT | 860 | 780 | 560 | 1030 | 1770 | 660 |
| Saybolt color | +6 | −1 | −1 | −5 | — | — |
| FIA (vol %) | | | | | | |
| RAFF | | | | | | |
| SAT | 87.1 | 83.9 | 84.7 | 84.1 | 81.0 | 85.8 |
| AROM | 12.9 | 16.1 | 15.3 | 15.9 | 19.0 | 14.2 |
| EXT | | | | | | |
| SAT | 40.8 | 36.2 | 44.8 | 31.3 | — | 47.4 |
| AROM | 59.2 | 63.8 | 55.2 | 68.7 | — | 52.6 |
| Selection rate | | | | | | |
| S vs AROM | 1.88 | 2.34 | 1.96 | 2.06 | — | 1.87 |
| N vs AROM | 3.99 | 3.69 | 2.87 | 4.15 | — | 3.18 |
| S vs OIL | 7.95 | 8.55 | 6.61 | 8.14 | 7.87 | 6.46 |
| N vs OIL | 16.86 | 13.45 | 9.66 | 16.35 | 24.58 | 11.00 |
| Rate of desulfurization (%) | 62.1 | 59.7 | 58.1 | 51.5 | 40.4 | 62.6 |
| Rate of denitration (%) | 79.4 | 75.9 | 76.7 | 74.5 | 69.2 | 77.3 |

TABLE 8

| | Light oil C treated with solvent below | | | |
|---|---|---|---|---|
| | DEG | FURF | SULF | DMSO |
| Solvent ratio | 1.0 | 1.0 | 1.0 | 1.0 |
| Yield (wt %) | | | | |
| RAFF | 98.8 | 91.8 | 96.3 | 96.3 |
| EXT | 1.2 | 8.2 | 3.7 | 3.7 |
| Sulfur content (wt. %) | | | | |
| RAFF | 0.187 | 0.122 | 0.163 | 0.152 |
| EXT | 1.515 | 1.075 | 1.442 | 1.549 |
| Nitrogen content (ppm) | | | | |
| RAFF | 107 | 62 | 91 | 75 |
| EXT | 10000 | 1250 | 2550 | 2550 |
| Saybolt color | <16 | −13 | −16 | −15 |
| FIA (vol %) | | | | |
| RAFF | | | | |
| SAT | 78.5 | 84.4 | 80.7 | 80.5 |
| AROM | 21.5 | 15.6 | 19.3 | 19.5 |
| EXT | | | | |
| SAT | — | 14.3 | 12.2 | 10.6 |
| AROM | — | 85.7 | 87.8 | 88.4 |

TABLE 8-continued

| | Light oil C treated with solvent below | | | |
|---|---|---|---|---|
| | DEG | FURF | SULF | DMSO |
| Selection rate | | | | |
| S vs AROM | — | 1.81 | 2.19 | 2.51 |
| N vs AROM | — | 4.14 | 6.92 | 8.36 |
| S vs OIL | 8.10 | 8.81 | 8.85 | 10.19 |
| N vs OIL | 93.46 | 20.16 | 28.02 | 34.00 |
| Rate of desulfurization (%) | 9.0 | 42.1 | 24.0 | 27.8 |
| Rate of denitration (%) | 49.0 | 71.2 | 58.4 | 65.1 |

As is obvious from TABLES 7 and 8, the process of this invention enabled relatively high yield of raffinate oil, rate of desulfurization and rate of denitration, while in compative test (TABLE 8) the rate of denitration was low, and the rate of desulfurization was very low.

B-3: Desulfurization/Denitration with Solvent containing Water

In the example a mixture of NMP and water having weight proportion of 1:2.0–20.2 was used as a solvent. A separatory funnel was charged with light oil C used in B-1 and the solvent containing water described above in the weight proportion of 1:1, and after it had been satisfactorily shaken, it was left to stand to allow the separation of two phases, a raffinate phase and an extracted phase. From both phases each oil phase was collected. The sulfur content and nitrogen content of said each oil phase were determined by the radiation type excite method according to JIS K 2541 and the nitrogen analysis method by chemiluminescence according to JIS K 2609, respectively. Also, these oil phases were subjected to FIA analysis according to JIS K 2536. Further, Saybolt color of the oil phase from the raffinate phase was determined according to JIS K 2580. The results are summarized in TABLE 9.

TABLE 9

| | Untreated light oil | Light oil C treated with solvent below | | | | |
|---|---|---|---|---|---|---|
| | | NMP | NMP | NMP | NMP | NMP |
| Solvent ratio | — | 1.0 | 1.0 | 1.5 | 2.5 | 4.0 |
| Added water content (wt %) | | 0.0 | 2.0 | 5.1 | 10.0 | 20.2 |
| Yield (wt %) | | | | | | |
| RAFF | — | 82.4 | 87.9 | 92.2 | 94.9 | 97.6 |
| EXT | — | 17.6 | 12.1 | 7.8 | 5.1 | 2.4 |
| Sulfur content (wt. %) | | | | | | |
| RAFF | 0.198 | 0.092 | 0.103 | 0.116 | 0.140 | 0.164 |
| EXT | — | 0.731 | 0.939 | 1.242 | 1.470 | 1.779 |
| Nitrogen content (ppm) | | | | | | |
| RAFF | 202 | 51 | 54 | 64 | 74 | 96 |
| EXT | — | 860 | 1120 | 1570 | 2100 | — |
| Saybolt color | <−16 | +6 | +2 | +3 | −8 | <−16 |
| FIA (vol %) | | | | | | |
| RAFF | | | | | | |
| SAT | 79.3 | 87.1 | 85.8 | 82.7 | 79.9 | 79.2 |
| AROM | 20.7 | 12.9 | 14.2 | 17.3 | 20.1 | 20.8 |
| EXT | | | | | | |
| SAT | — | 40.8 | 29.7 | 11.8 | 8.7 | 5.5 |
| AROM | — | 59.2 | 70.3 | 88.2 | 91.3 | 94.5 |
| Selection rate | | | | | | |
| S vs AROM | — | 1.88 | 2.03 | 2.37 | 2.61 | 2.70 |
| N vs AROM | — | 3.99 | 4.62 | 5.79 | 7.05 | — |
| S vs OIL | — | 7.95 | 9.12 | 10.71 | 10.50 | 10.85 |
| N vs OIL | — | 16.86 | 20.74 | 26.17 | 28.38 | — |
| Rate of desulfurization (%) | — | 62.1 | 54.7 | 46.8 | 33.6 | 20.3 |
| Rate of denitration (%) | — | 79.4 | 76.7 | 73.0 | 65.6 | 54.2 |

As is obvious from TABLE 9, the yield of raffinate oil becomes higher as added water content is more.

B-4: Extraction of Fractional Distillates of IGO with Solvent

In the example three fractional distillates of light oil C used in B-1 were desulfurized and denitrated. These distillates were ones with distillation range between the initial boiling point and 290° C. (distillate A), between 290° C. and 310° C. (distillate B), and between 310° C. and the stop point (distillate C). A separatory funnel was charged with each distillate and NMP, the solvent in the weight proportion of 1:1, and after it had been satisfactorily shaken, it was left to stand to allow the separation of two phases, a raffinate phase and an extracted phase. From both phases each oil phase was collected. The sulfur content and nitrogen content of said each oil phase were determined by the radiation type excite method according to JIS K 2541 and the nitrogen analysis method by chemiluminescence according to JIS K 2609, respectively. Also, these oil phases were subjected to FIA analysis according to JIS K 2536. Further, Saybolt color of the oil phase from the raffinate phase was determined according to JIS K 2580. The results are summarized in TABLE 10.

TABLE 10

| | Ditillate A | | Ditillate B | | Ditillate C | |
|---|---|---|---|---|---|---|
| | a | b | a | b | a | b |
| Solvent ratio | | 1.0 | — | 1.0 | — | 1.0 |
| Yield (wt %) | | | | | | |

TABLE 10-continued

| | Ditillate A | | Ditillate B | | Ditillate C | |
|---|---|---|---|---|---|---|
| | a | b | a | b | a | b |
| RAFF | — | 78.5 | — | 83.8 | — | 85.4 |
| EXT | — | 21.5 | — | 16.2 | — | 14.6 |
| Sulfur content (wt. %) | | | | | | |
| RAFF | 0.042 | 0.029 | 0.169 | 0.075 | 0.358 | 0.153 |
| EXT | — | 0.108 | — | 0.683 | — | 1.605 |
| Nitrogen content (ppm) | | | | | | |
| RAFF | 56 | 27 | 128 | 35 | 336 | 87 |
| EXT | — | 167 | — | 530 | — | 1960 |
| Saybolt color | +17 | +27 | −5 | +21 | <−16 | −16 |
| FIA (Vol %) | | | | | | |
| RAFF | | | | | | |
| SAT | 78.9 | 86.7 | 80.5 | 87.3 | 79.0 | 87.8 |
| AROM | 21.1 | 13.3 | 19.5 | 12.7 | 21.1 | 12.2 |
| EXT | | | | | | |
| SAT | — | 50.2 | — | 45.6 | 10.2 | |
| AROM | — | 49.8 | — | 54.4 | — | 89.8 |
| Selection rate | | | | | | |
| S vs AROM | — | 1.06 | — | 2.29 | — | 1.63 |
| N vs AROM | — | 1.76 | — | 3.80 | — | 3.38 |
| S vs OIL | — | 3.72 | — | 9.11 | — | 10.49 |
| N vs OIL | — | 6.19 | — | 15.14 | — | 21.79 |
| Rate of desulfurization (%) | — | 47.3 | — | 63.9 | — | 65.2 |
| Rate of denitration (%) | — | 63.2 | — | 77.8 | — | 78.9 |

(Footnote)
The column "a" indicates the values of untreated distillates, and the column "b" indicates the values of treated distillates.

As is obvious from TABLE 10, the higher the boiling point of the ditillate is, the higher the rate of desulfurization and the rate of denitration are. In addition, since most of the sulfur components and nitrogen components concentrate in the distillate with higher distillation range, one can see that the desulfurization and denitration can be effected with high efficiency, when the extraction is effcted for the distillate of light oil with higher distillation range after light oil was fractionated by distillation.

B-5: Extraction of Light Oil of Low Sulfur Content with Solvent

A separatory funnel was charged with light oil of low sulfur content (having a sulfur content of 0.064% by weight and a nitrogen content of 186 ppm, reffered to as light oil D) and NMP, the solvent in a weight proportion of 1:1 or 1:2.5, and after it had been satisfactorily shaken, it was left to stand to allow the separation of two phases, a raffinate phase and an extracted phase. From both phases each oil phase was collected. The sulfur content and nitrogen content of said each oil phase were determined by the radiation type excite method according to JIS K 2541 and the nitrogen analysis method by chemiluminescence according to JIS K 2609, respectively. Also these oil phases were subjected to FIA analysis according to JIS K 2536. Further, Saybolt color of the oil phase from the raffinate phase was determined according to JIS K 2580. The results are summarized in TABLE 11.

TABLE 11

| | Untreated | Light oil D treated with solvent below | |
|---|---|---|---|
| | light oil | NMP | NMP |
| Solvent ratio | — | 1.0 | 2.5 |
| Yield (wt %) | | | |
| RAFF | — | 82.1 | 69.0 |
| EXT | — | 17.9 | 31.0 |
| Sulfur content (wt. %) | | | |
| RAFF | 0.064 | 0.023 | 0.014 |
| EXT | — | 0.225 | 0.164 |
| Nitrogen content (ppm) | | | |
| RAFF | 186 | 42 | 21 |
| EXT | — | 820 | 510 |
| Saybolt color | <−16 | −1 | +15 |
| FIA (vol %) | | | |
| RAFF | | | |
| SAT | 77.7 | 85.3 | 90.4 |
| AROM | 22.3 | 14.7 | 9.6 |
| EXT | | | |
| SAT | — | 40.0 | 48.1 |
| AROM | — | 60.0 | 51.9 |
| Selection rate | | | |

TABLE 11-continued

| | Untreated light oil | Light oil D treated with solvent below NMP | NMP |
|---|---|---|---|
| S vs AROM | — | 2.59 | 2.34 |
| N vs AROM | — | 5.18 | 4.84 |
| S vs OIL | — | 9.78 | 11.71 |
| N vs OIL | — | 19.52 | 24.29 |
| Rate of desulfurization (%) | — | 71.1 | 85.2 |
| Rate of denitration (%) | | 81.8 | 92.3 |

Also in the case of light oil of low sulfur content, the rate of desulfurization and the rate of denitration became higher with a rise in the solvent ratio.

B-6: Multistage Extraction

In the example the multistage extraction was effected utilizing as a solvent light oil C used in B-1 (having a sulfur content of 0.198% by weight) or light oil D used in B-5 (having a sulfur content of 0.064% by weight). The number of stages was 3, and the solvent ratio was 1.0 ultimately. The results are summarized in TABLE 12.

TABLE 12

| | Light oil C | | | Light oil D | | |
|---|---|---|---|---|---|---|
| | The number of stage | | | | | |
| | 1st | 2nd | 3rd | 1st | 2nd | 3rd |
| RAFF Yield (wt %) | (83.6) | (80.6) | 76.6 | (88.0) | (83.9) | 74.8 |
| Sulfur content (wt. %) | 0.115 | 0.072 | 0.040 | 0.036 | 0.024 | 0.015 |
| Nitrogen content (ppm) | 60 | 35 | 17 | 50 | 23 | 12 |
| Saybolt color | −1 | +15 | +20 | −7 | +14 | +23 |
| FIA (vol %) | | | | | | |
| SAT | 83.4 | 85.0 | 91.6 | 79.7 | 84.6 | 90.0 |
| AROM | 16.6 | 15.0 | 8.4 | 20.3 | 15.4 | 10.0 |
| Aromatic component of RAFF (vol %) | | | | | | |
| monocyclic | — | — | 7.4 | — | — | 7.3 |
| polycyclic | — | — | 0.0 | — | — | 0.0 |
| Cetane index | | | | | | |
| JIS | — | — | 67.6 | — | — | 68.5 |
| ASTM | — | — | 69.9 | — | — | 71.0 |

As is obvious from TABLE 12, when the multistage extraction was effected according to this invention, good results of desulfurization and denitration were obtained even though the solvent ratio was low. It was also recognized that the level of decolorization became higher with an increase in the number of stages. Further, it was proved that the solvent in this invention tended to extract polycyclic aromatic components more than monocyclic ones.

B-7: Separation of Extracted Phase into Solvent and Extracted Oil

In the example the regeneration of an solvent was attempted. At first an extracted phase was obtained by subjecting light oil to extraction with a solvent, NMP. The extracted phase had an extracted oil content of 12.6% by weight and a solvent content of 87.4% by weight. 20, 50 or 100% by weight of water was added to the extracted phase, and after it had been satisfactorily shaken, it was left to stand to allow the separation of the water phase and oil phase. Each phase was examined for the distribution of components. The results are summarized in TABLE 13.

TABLE 13

| | The quantity of add water | | | | | | |
|---|---|---|---|---|---|---|---|
| | 0% | 20% | | 50% | | 100% | |
| Separated phases | — | EXT | NMP | EXT | NMP | EXT | NMP |
| Weight of phase (wt. %) | — | 7.6 | 92.4 | 7.5 | 92.5 | 6.0 | 94.0 |
| Distribution | | | | | | | |
| Extracted oil | — | 70.1 | 29.9 | 87.5 | 12.5 | 94.9 | 5.1 |

TABLE 13-continued

| | The quantity of add water | | | | | | |
|---|---|---|---|---|---|---|---|
| | 0% | 20% | | 50% | | 100% | |
| NMP | — | 0.4 | 99.6 | 0.3 | 99.7 | 0.1 | 99.9 |
| Composition | | | | | | | |
| Extracted oil | 12.6 | 96.4 | 3.4 | 98.0 | 1.2 | 99.3 | 0.3 |
| NMP | 87.4 | 3.6 | 78.5 | 2.0 | 62.8 | 0.7 | 46.5 |
| Water | — | 0.0 | 18.1 | 0.0 | 36.0 | 0.0 | 53.2 |
| Total | 100.0 | 100.0 | 100.0 | 100.0 | 100.0 | 100.0 | 100.0 |

When water is added to an extracted phase which comprises an solvent and extracted oil, the solvent in most of the cases becomes an aqueous solution if the solvent is NMP. A little extracted oil is contained in the aqueous solution, but most of the extracted oil forms an extracted oil phase. As a mixture of NMP and water is not an azotropic mixture, the NMP can be removed with the aid of the difference of boiling points between NMP and water. In this way, NMP can be removed to be used again as a solvent. In addition, the oil phase is little contaminated by NMP, and the more the quantity of added water is, the less the level of contamination is.

Meanwhile, the process described above is more effctive from a standpoint of process cost than the process wherein the extracted phase is directly distilled.

What is claimed is:

1. A process for the desulfurization of light oil that is a petroleum fraction having a boiling point between a boiling point of kerosine and a boiling point of heavy oil, comprising:

reacting said light oil with hydrogen in the presence of a catalyst for hydrodesulfurizing the light oil, contacting the hydrodesulfurized light oil with at least one pyridinium salt as a solvent in a weight proportion of the light oil to the solvent of 1:0.5–4.0 to produce a desulfurized light oil, and separating the at least one pyridinium salt from the desulfurized light oil.

2. A process according to claim 1, wherein said at least one pyridinium salt is selected from the group consisting of trimethylpyridinium hydrobromide, 1,2,4,6-tetramethylpyridinium iodide, N-ethylpyridinium bromide and mixtures thereof.

3. A process according to claim 1, wherein said at least one pyridinium salt is used together with at least one second solvent having one or more hydroxyl groups.

4. A process according to claim 3, wherein said at least one second solvent having one or more hydroxyl groups is selected from the group consisting of water, methanol, ethanol, propanol, butanol, ethylene glycol, glycerol and mixtures thereof.

5. A process according to claim 1, wherein said hydrodesulfurized light oil is contacted with said at least one pyridinium salt at a temperature of from 20° C. to 60° C.

6. A process according to claim 1, wherein light oil obtained from said process has a sulfur content not exceeding 0.1% by weight.

7. A process according to claim 6, wherein light oil obtained from said process has a sulfur content not exceeding 0.01% by weight.

* * * * *